US009287612B2

(12) United States Patent
Bolin et al.

(10) Patent No.: US 9,287,612 B2
(45) Date of Patent: Mar. 15, 2016

(54) TRANSPARENT ANTENNAS FOR WIRELESS TERMINALS

(71) Applicant: Sony Mobile Communications AB, Lund (SE)

(72) Inventors: Thomas Bolin, Lund (SE); Henrik Jensfelt, Lund (SE); Zhinong Ying, Lund (SE)

(73) Assignee: Sony Mobile Communications AB, Lund (SE)

( * ) Notice: Subject to any disclaimer, the term of this patent is extended or adjusted under 35 U.S.C. 154(b) by 518 days.

(21) Appl. No.: 13/679,527

(22) Filed: Nov. 16, 2012

(65) Prior Publication Data

US 2014/0139379 A1 May 22, 2014

(51) Int. Cl.

| | |
|---|---|
| ***H01Q 9/06*** | (2006.01) |
| ***H01Q 1/24*** | (2006.01) |
| *H01Q 1/38* | (2006.01) |
| *H01Q 21/30* | (2006.01) |
| *H01Q 5/371* | (2015.01) |
| *H01Q 5/378* | (2015.01) |

(52) U.S. Cl.
CPC ..... *H01Q 1/243* (2013.01); *H01Q 9/06* (2013.01); *H01Q 1/38* (2013.01); *H01Q 5/371* (2015.01); *H01Q 5/378* (2015.01); *H01Q 21/30* (2013.01)

(58) Field of Classification Search
CPC ..... H01Q 1/243; H01Q 9/06
USPC ..... 343/702, 700 MS
See application file for complete search history.

(56) References Cited

U.S. PATENT DOCUMENTS

| | | | | |
|---|---|---|---|---|
| 2010/0002282 | A1* | 1/2010 | Agrawal et al. | 359/275 |
| 2011/0279335 | A1 | 11/2011 | Degen et al. | |
| 2012/0019418 | A1* | 1/2012 | Wong et al. | 343/702 |
| 2012/0092221 | A1 | 4/2012 | Schlub et al. | |

FOREIGN PATENT DOCUMENTS

| | | | |
|---|---|---|---|
| CN | 102347527 | A | 2/2012 |
| CN | 202308264 | U | 7/2012 |
| CN | 102683861 | A | 9/2012 |
| EP | 2 369 674 | A2 | 9/2011 |
| EP | 2 403 064 | A1 | 1/2012 |
| WO | WO 2010/081589 | A1 | 7/2010 |

OTHER PUBLICATIONS

European Search Report Corresponding to European Application No. 13186149.4; Dated: Apr. 9, 2014; 10 Pages.

(Continued)

*Primary Examiner* — Dameon E Levi
*Assistant Examiner* — Andrea Lindgren Baltzell
(74) *Attorney, Agent, or Firm* — Myers Bigel Sibley, P.A.

(57) ABSTRACT

Transparent antennas are described. An antenna apparatus for a radio transceiver of a wireless communication terminal having a housing includes a transparent antenna coupled to the housing around a perimeter of the housing and electrically connected to the transceiver. The transparent antenna has a conductive mesh acting as one or more radiating elements. Light and images may pass through the transparent antenna. The transparent antenna may have a ring shape around the housing of the terminal.

13 Claims, 9 Drawing Sheets

(56) References Cited

OTHER PUBLICATIONS

Hautcoeur et al. "Performances of Transparent Monopole Antenna versus Meshed Silver Layer (AgGL)" Antennas and Propagation (EuCAP), 2010 Proceedings of the Fourth European Conference, Apr. 12-16, 2010, pp. 1-3.

Chinese Office Action and Search Report corresponding to Application No. 201310439111.8, Dated Jun. 4, 2015. (Foreign text).

* cited by examiner

TRANSPARENT ANTENNAS FOR WIRELESS TERMINALS

FIELD

The present inventive concepts generally relate to the field of communications and, more particularly, to antennas and wireless electronic devices incorporating the same.

BACKGROUND

Wireless terminals may operate in multiple frequency bands (i.e., "multi-band") to provide operations in multiple communications systems. For example, Long Term Evolution (LTE) Multiple-Input and Multiple-Output (MIMO) cellular radiotelephones may be designed for operation in nominal frequency bands such as 700-800 Megahertz (MHz), 824-894 MHz, 880-960 MHz, 1710-1850 MHz, 1820-1990 MHz, 1920-2170 MHz, and 2500-2700 MHz.

Wireless terminals are designed to operate at multiple frequency bands. The antennas of wireless terminals are made of conductive materials that are metallic, dark and/or opaque. This limits the range of design opportunities for the "look and feel" of wireless terminals.

SUMMARY

Various embodiments of the present inventive concepts include transparent or translucent antenna for wireless terminals. In various embodiments, an antenna apparatus for a radio transceiver of a wireless communication terminal having a housing. The housing may have a flat surface and a side surface encircling the face surface. The antenna apparatus includes a transparent ring antenna that extends around at least three sides of a perimeter of the housing. The transparent ring antenna comprises a transparent substrate and a conductive mesh on the transparent substrate. The conductive mesh provides conductivity such that the transparent ring antenna transmits and/or receives wireless signals. The transparent ring antenna allows for at least a majority of incident light to pass through the transparent ring antenna. In some embodiments, a meander-line inductor may be printed on a low-band branch of the conductive mesh.

In further embodiments, the transparent ring antenna is configured to transmit via a plurality of frequency bands responsive to signals generated by a multi-band transceiver.

In some embodiments, the transparent ring antenna is less transparent and more conductive than the rest of the transparent ring antenna at a portion of the transparent ring antenna near an electrical feed coupled to the transparent ring antenna. In other embodiments, the transparent ring antenna is further configured to receive signals from the transceiver by capacitive coupling to circuitry of the transceiver. In further embodiments, the transparent ring antenna is coupled to a dielectric frame that is between the transparent ring antenna and a backplate of the housing. The dielectric frame may comprise plastic, glass and/or ceramic materials.

In an embodiment, the transparent ring antenna also includes a first transparent mesh radiating element that extends along a first portion of the perimeter of the housing and is configured to transmit and/or receive non-cellular signals for the transceiver and a second transparent mesh radiating element that extends along a second portion of the perimeter of the housing and is configured to transmit and/or receive cellular signals for the transceiver.

In a further embodiment, the transparent ring antenna further comprises a third transparent mesh radiating element that extends along a third portion of the perimeter of the housing and is configured to transmit and/or receive cellular signals for transceiver, wherein the second and third transparent mesh radiating elements are configured for multiple input multiple output (MIMO) communication. In some embodiments, the first transparent mesh radiating element may be configured to transmit and receive at least one of local wireless networks (e.g., WiFi) and global positioning system (GPS) signals.

In an embodiment, the first transparent mesh radiating element extends around a first edge of the housing, the second transparent mesh radiating element extends along a second edge of the housing and a portion of a third edge of the housing, and the third transparent mesh radiating element extends along a fourth edge of the housing opposite the second edge and a portion of the third edge of the housing.

In another embodiment, the antenna apparatus includes a light source coupled to the housing and configured to emit light of a color through the transparent ring antenna.

In another embodiment, an antenna apparatus for a radio transceiver of a wireless communication terminal having a housing includes a transparent antenna coupled to the housing around a perimeter of the housing and electrically connected to the transceiver. The transparent material has a conductive mesh acting as one or more radiating elements.

In some embodiments, the transparent antenna may be less transparent and more conductive than the rest of the transparent antenna at a portion of the transparent antenna near an electrical feed coupled to the transparent antenna. In other embodiments, the transparent ring antenna is further configured to receive signals from the transceiver by capacitive coupling to circuitry of the transceiver. In various embodiments, the terminal includes a light source coupled to the body and configured to emit light through the transparent antenna.

In a further embodiment, the transparent antenna also includes a first transparent mesh radiating element that extends along a first portion of the perimeter of the housing and is configured to transmit and receive non-cellular signals for the transceiver, a second transparent mesh radiating element that extends along a second portion of the perimeter of the housing and is configured to transmit and receive cellular signals for the transceiver, and a third transparent mesh radiating element that extends along a third portion of the perimeter of the housing and is configured to transmit and receive cellular signals for the transceiver, wherein the second and third transparent mesh radiating elements are configured for multiple input multiple output (MIMO) communication.

In another embodiment, an antenna apparatus for a radio transceiver of a wireless communication terminal having a housing includes a translucent antenna coupled to the housing around a perimeter of the housing and electrically connected to the transceiver. The translucent material has a conductive mesh acting as one or more radiating elements.

In some embodiments, the translucent ring antenna may be less translucent and more conductive than the rest of the translucent ring antenna at a portion of the translucent ring antenna near an electrical feed coupled to the translucent ring antenna. In other embodiments, the translucent ring antenna is further configured to receive signals from the transceiver by capacitive coupling to circuitry of the transceiver. In various embodiments, the terminal includes a light source coupled to the body and configured to emit light through the translucent ring antenna.

In a further embodiment, the translucent ring antenna also includes a first translucent mesh radiating element that extends along a first portion of the perimeter of the housing and is configured to transmit and receive non-cellular signals for the transceiver, a second translucent mesh radiating element that extends along a second portion of the perimeter of the housing and is configured to transmit and receive cellular signals for the transceiver, and a third translucent mesh radiating element that extends along a third portion of the perimeter of the housing and is configured to transmit and receive cellular signals for the transceiver, wherein the second and third translucent mesh radiating elements are configured for multiple input multiple output (MIMO) communication.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION OF EMBODIMENTS

Figure 1:
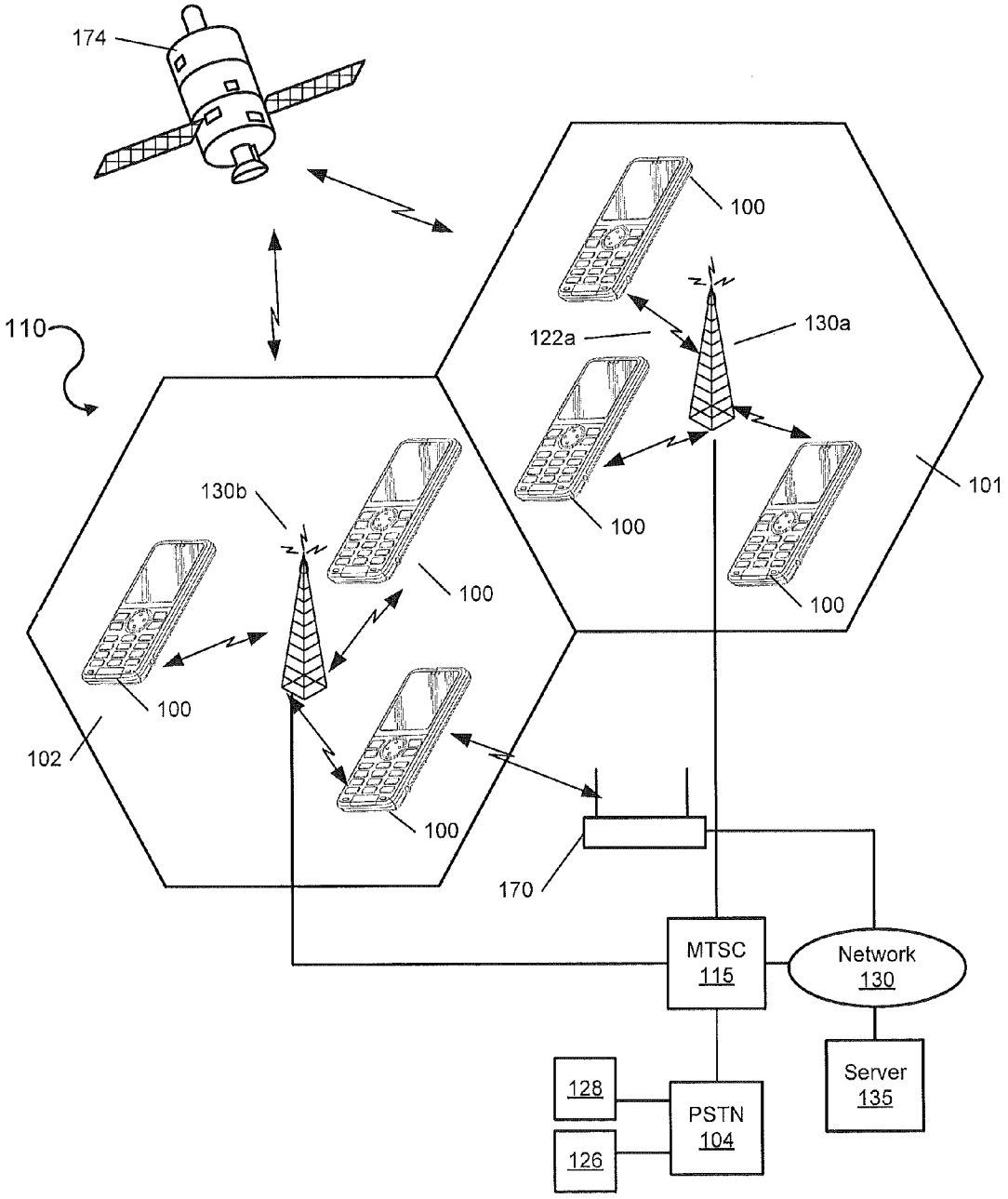
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in two or more frequency bands.

Wireless electronic devices, such as cell phones, tablets or other wireless terminals, may be designed for use within a communication network. FIG. 1 shows a diagram of a wireless communications network 110 that supports communications in which wireless electronic devices 100 can be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. Network 110 may include wireless electronic devices 100 that may communicate with base stations 130*a*, 130*b*. The wireless electronic devices 100 in network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to network 110. As also shown in FIG. 1, the MTSC 115 is coupled to a computer server 135 via a network 130, such as the Internet.

Network 110 is organized as cells 101, 102 that collectively can provide service to a broader geographic region. In particular, each of cells 101, 102 can provide service to associated sub-regions (e.g., regions within the hexagonal areas illustrated by cells 101, 102 in FIG. 1) included in the broader geographic region covered by network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. Each of cells 101, 102 may include an associated base station 130*a*, 130*b*. The base stations 130*a*, 130*b* can provide wireless communications between each other and the wireless electronic devices 100 in the associated geographic region covered by the network 110.

Each of base stations 130*a*, 130*b* can transmit/receive data to/from the wireless electronic devices 100 over an associated control channel. For example, base station 130*a* in cell 101 can communicate with one of the wireless electronic devices 100 in cell 101 over control channel 122*a*. Control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments according to the inventive concepts, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. Network 110 may also provide network location information as the basis for the location information applied by the wireless electronic devices 100. In addition, the location information may be provided directly to server 135 rather than to the wireless electronic devices 100 and then to server 135. Additionally or alternatively, the wireless electronic devices 100 may communicate with local wireless network 170.

Transparent monopole antennas have been proposed so that base stations 130*a* and 130*b* may have less visual impact. A transparent material allows light to pass through it without significant scattering. Objects and light on the other side of a transparent material are seen as they are, preserving the pass through images. Some techniques for producing transparent antennas have involved using a transparent conducting oxide (TCO) deposited on a transparent substrate. Example transparent conducting films may be indium tin oxide (ITO) or fluorine doped tin oxide (FTO). Some techniques have involved an AgHT coated film with narrow silver paste strips laid on coplanar antenna edges.

Transparent monopole antennas for towers may also involve metal meshes printed on optically transparent substrates. The meshes have thin lines and relatively large open spaces between the squares so that the meshes have little effect on the transparency of the antenna. Such techniques for creating transparent metal meshes are discussed in a paper by J. Hautcoeur et al. titled "Performances of Transparent Monopole Antenna versus Meshed Silver Layer (AgGL)" of the *Institut d'Electronique et de Télécommunications de Rennes*, which is herein incorporated by reference in its entirety. For example, a 6 nm thick silver (AG) film with an ultrathin adhesion layer of titanium can be deposited by RF magnetron sputtering on a 1737 Corning glass 0.7 mm thick. Using standard photolithographic wet etching, a mesh structure may be printed on the bilayer. The photoresist may be stripped, leaving a periodic array of square apertures in the metal layers with a pitch of about 100 μM. Other pitches, such as 200 μm or 300 μm, may also be used. Of course, this is only one example of creating a conductive mesh on a transparent substrate. Other materials and techniques may be used for creating transparent mesh antennas, with or without additional transparent conductive films. In some cases, antenna materials may be translucent, meaning that light may pass through the substrate but the detailed images may not.

The paper referenced above has related to transparent monopole antennas, such as for base stations 130*a* and 130*b*. However, there are also some physical and visual design limitations of wireless terminals. This is due to the terminal antennas, which are made of opaque materials. Various embodiments described herein use transparent mesh antennas for wireless communication terminals. The transparent antennas may be of a monopole, C-fed monopole, curved or ring shape. Transparent antennas may also form a ring around a perimeter of a wireless communication terminal. Moreover, such wireless terminals may provide desirable industrial design features such as a metal backplate or colored lights through the transparent antennas.

In other embodiments, the transparent antenna may require more conductivity near the electrical feeds of the antennas. Therefore, there may be less transparency or more conductivity in the antennas near the feeds. This may involve an additional mesh, a thick mesh, a tighter mesh, or more conductive elements combined with the mesh.

According to various embodiments, terminal antennas may be transparent through the combination of transparent materials, such as plastic or glass, and conductive meshes. These conductive meshes may be metal meshes formed by photolithographic wet etching techniques. Transparent antennas may be configured in various ways on or around a wireless terminal.

Figure 2A:
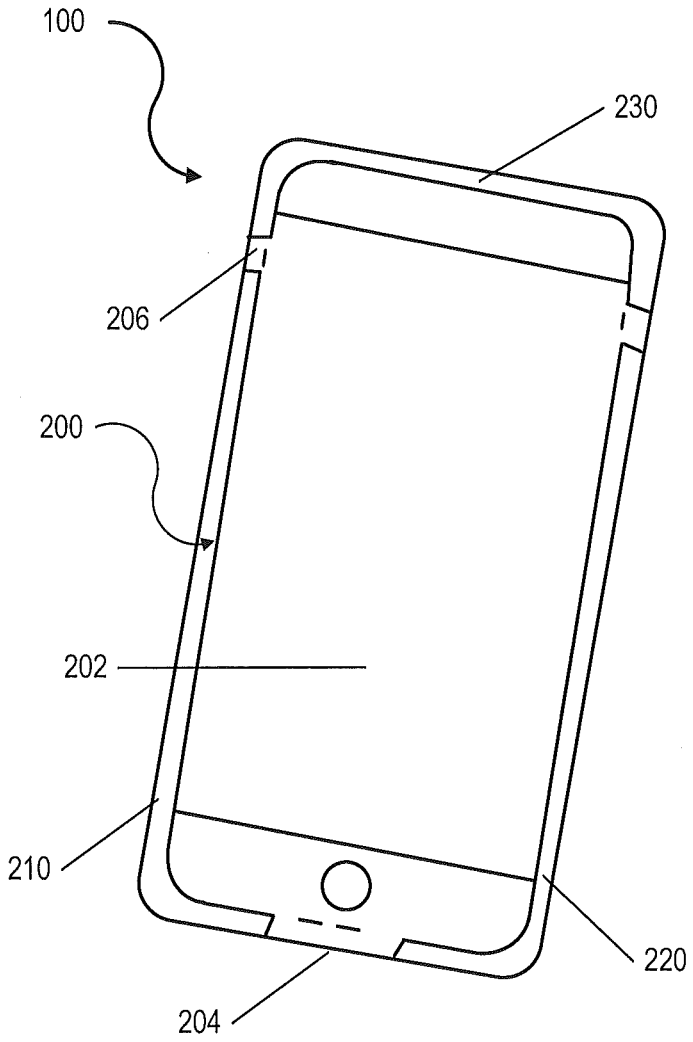
FIGS. 2A and 2B illustrate front and side views, respectively, of a wireless electronic device having an antenna according to various embodiments of the present inventive concepts.
Figure 3:
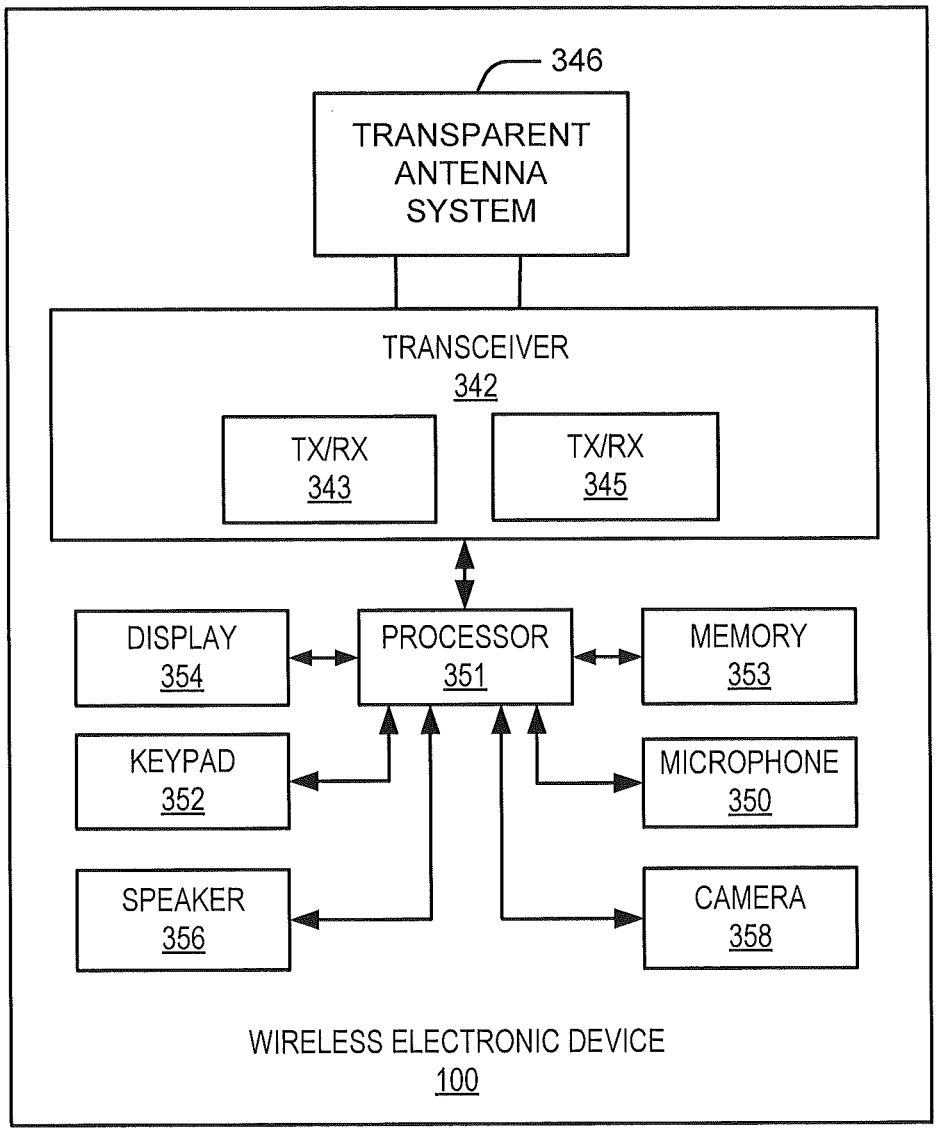
FIG. 3 is a block diagram illustrating a wireless electronic device having an antenna according to various embodiments of the present inventive concepts.

For example, FIG. 2A illustrates a wireless electronic device 100, according to various embodiments of the present inventive concepts. Wireless electronic device 100 has one or more transparent antennas, 210, 220 and 230. Each of transparent antennas 210, 220 and/or 230 may be configured around housing 200 of wireless electronic device 100, according to an embodiment. There may be gaps or pathways for connections or button controls, such as gaps 204 and 206. Housing 200 may be a portion of the phone housing hardware in a chassis such as display 202, a transceiver, a processor and other components that are shown in FIG. 3.

According to embodiments, wireless electronic device 100 may include two or more transparent antennas. In some embodiments, at least one of the antennas 210, 220, 230 may be a monopole antenna or a planar inverted-F antenna (PIFA), among others. In other embodiments, transparent antennas 210, 220 and 230 may be curved antennas. In various embodiments, a single transparent antenna may have multiple radiating elements configured for wireless communications. For example, each of transparent antennas 210, 220 or 230 may include one or more radiating elements. In any case, when referring to multiple transparent antennas, this may also include a single transparent antenna with multiple radiating elements.

Figure 2B:
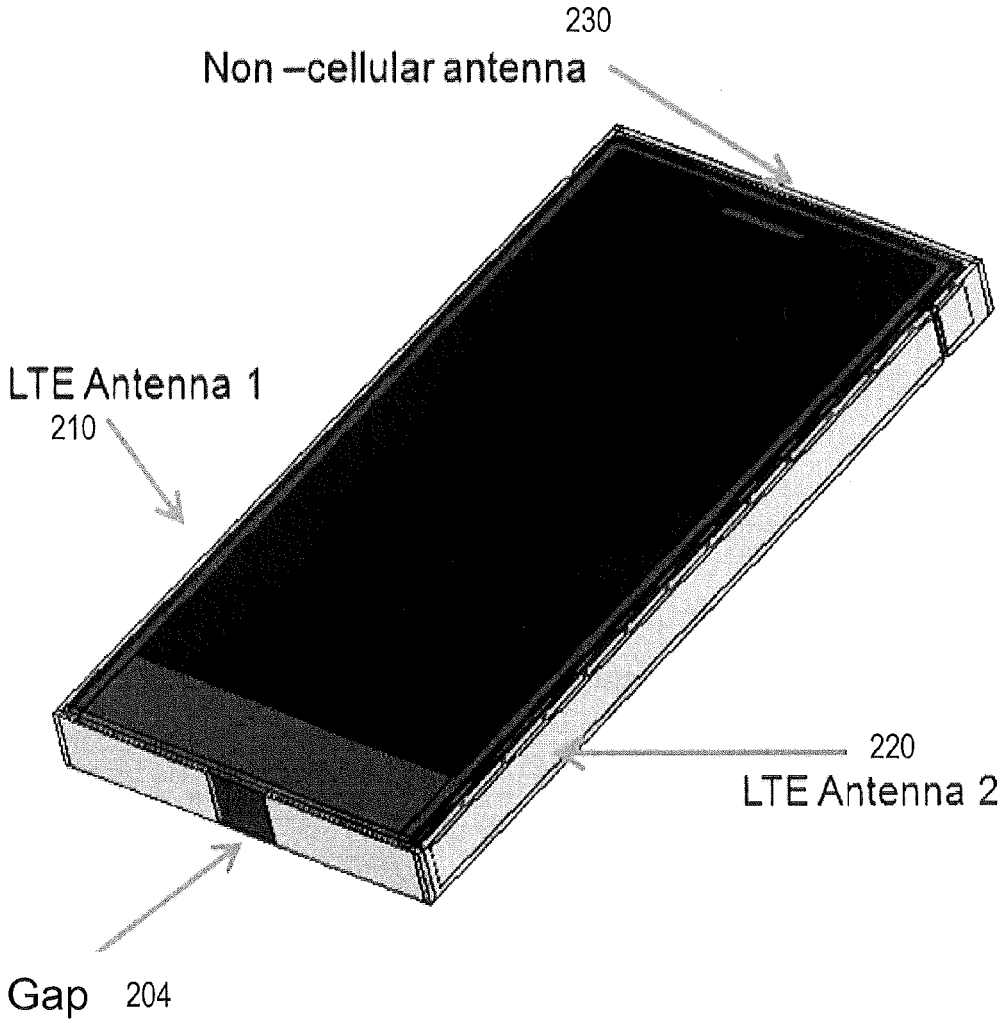

According to various embodiments, FIG. 2A shows an example wireless electronic device 100 having three transparent antennas or three radiating elements of a single transparent antenna. At least one of the antennas 210, 220, 230 may be a multi-band antenna and/or may be configured to communicate cellular and/or non-cellular frequencies. For example, as shown in FIG. 2B, transparent antennas 210 and 220 may be configured for cellular communication (e.g., LTE network) and for multiple in multiple out (MIMO) technology. Transparent antenna 230 may be configured for sending and receiving non-cellular signals, such as for GPS and WiFi purposes.

Housing 200 of the wireless electronic device 100 in FIGS. 2A and 2B may be covered or overlapped by at least a portion of antennas 210, 220, 230. Transparent antennas 210, 220 and 230 may be located on any side edge of housing 200. They may be curved as to cover part of an adjacent side edge. In this example, transparent antenna 230 covers a top edge of the wireless terminal and perhaps a little around the corners of the top edge. Transparent antennas 210 and 220 extend along either side of the terminal and perhaps cover a portion of the bottom edge of the terminal, stopping at gap 204. Transparent antenna 210 may also form a ring or partial ring along (e.g., adjacent) the perimeter of housing 200. In some embodiments, a transparent antenna may be a half ring, such as two branches extending from the bottom of a mobile terminal. In other embodiments, a transparent antenna may be located only on the bottom of a mobile terminal.

Two transparent antennas 210 and 220 may be spaced apart from each other along one end portion of housing 200. A gap 204 between the first and second transparent antennas 210 and 220 along the end portion of housing 200 may have a distance/length D of about 8.0 millimeters (mm) or greater (e.g., may range from about 8.0 mm to about 20.0 mm). Gap 204 provides physical and electrical isolation (e.g., to reduce coupling) between the first and second transparent antennas 210 and 220. Gap 204 may be a void or may include a dielectric/insulative material. Additionally or alternatively, gap 204 may include a connector that is configured to provide at least one of power, audio, video, and Universal Serial Bus (USB) connections.

Transparent antenna 230 may be a non-cellular antenna that is configured for applications such as Global Positioning System (GPS), Wireless Local Area Network (WLAN)(e.g., 802.11), or Bluetooth. The first and second transparent antennas 210 and 220, on the other hand, may be cellular (e.g., LTE) antennas. It will be understood, however, that the third transparent antenna 230 may alternatively be a cellular antenna, and that one of the first and second transparent antennas 210 and 220 may be a non-cellular antenna. Moreover, the wireless electronic device 100 may be configured to select (e.g., using antenna swapping/switching techniques) one or more of the first, second, and third transparent antennas 210, 220, and 230 for cellular communications. For example, the wireless electronic device 100 may determine that the second transparent antenna 220 will provide stronger signal qualities than the first transparent antenna 210, and may therefore select the second transparent antenna 220 for cellular communications.

There are also issues specific to designing transparent mesh antennas for wireless terminals. These are addressed. Embodiments may use a capacitive coupling structure between a transparent antenna and the radio or transceiver of the terminal. This provides even more flexibility in the visual design of a wireless terminal. For example, a capacitive feed may include a radiator conductor coupled to a feed plate that is 12×4 mm and connected to the radio. The radiator conductor may be positioned along the edges of a phone. In this example, the length of the radiator conductor may be 125 mm for the frequency bands of 700-2700 MHz. The radiator conductor may be coupled to the feed plate through a 1 mm thick dielectric material such as plastic or glass to form an approx 1 pF capacitor. In some cases, a dielectric material may surround a wireless terminal with conductive material on an inside surface and an outside surface of the dielectric.

Referring now to FIG. 3, a block diagram is provided illustrating a wireless electronic device 100, according to various embodiments of the present inventive concepts. As illustrated in FIG. 3, a wireless electronic device 100 may include a transparent antenna system 346, a transceiver 342, and a processor 351. The wireless electronic device 100 may further include a display 354, keypad 352, speaker 356, memory 353, microphone 350, and/or camera 358.

A transmitter portion of transceiver 342 converts information, which is to be transmitted by the wireless electronic device 100, into electromagnetic signals suitable for radio communications (e.g., to the network 110 illustrated in FIG. 1). A receiver portion of the transceiver 342 demodulates electromagnetic signals, which are received by the wireless electronic device 100 from the network 110 to provide the information contained in the signals in a format understandable to a user of the wireless electronic device 100. The transceiver 342 may include transmit/receive circuitry (TX/RX) that provides separate communication paths for supplying/receiving RF signals to different radiating elements of the transparent (and perhaps multi-band) antenna system 346 via their respective RF feeds. Accordingly, when the transparent antenna system 346 includes two active antenna elements (e.g., the antennas 210, 220), the transceiver 342 may include two transmit/receive circuits 343, 345 connected to different ones of the antenna elements via the respective RF feeds.

The transceiver 342, in operational cooperation with the processor 351, may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), 4G, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, and 2500-2700 MHz, among others. Other radio access technologies and/or frequency bands can also be used in embodiments according to the inventive concepts. Various embodiments may provide coverage for non-cellular frequency bands such as Global Positioning System (GPS), WLAN, and/or Bluetooth frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth compliant interface.

The wireless electronic device 100 is not limited to any particular combination/arrangement of the keypad 352 and the display 354. As an example, it will be understood that the functions of keypad 352 and display 354 can be provided by a touch screen through which the user can view information, such as computer displayable documents, provide input thereto, and otherwise control the wireless electronic device 100. Additionally or alternatively, the wireless electronic device 100 may include a separate keypad 352 and display 354. Moreover, it will be understood that the transparent antennas 210 and 220 may substantially provide the sides/edges of the entire wireless electronic device 100 between a backplate and display 354.

Referring still to FIG. 3, the memory 353 can store computer program instructions that, when executed by processor circuit 351, carry out the operations (e.g., antenna selection) described herein and shown in the figures. As an example, the memory 353 can be non-volatile memory, such as EEPROM (flash memory), that retains the stored data while power is removed from the memory 353.

Figure 4A:
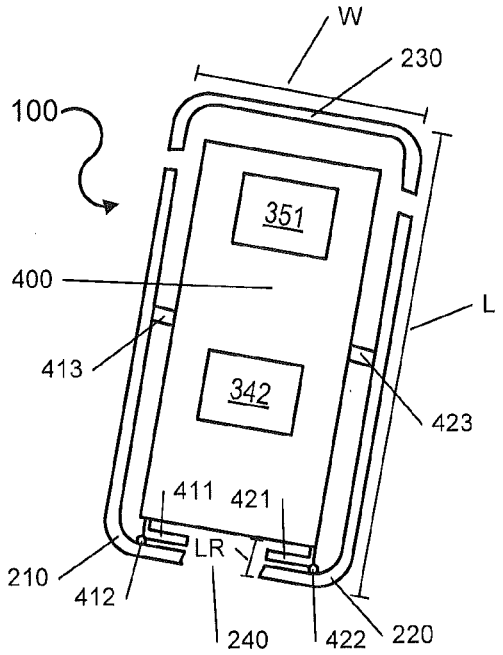
FIGS. 4A and 4B illustrate detailed views of antennas of a wireless electronic device, according to various embodiments of the present inventive concepts.
Figure 4B:
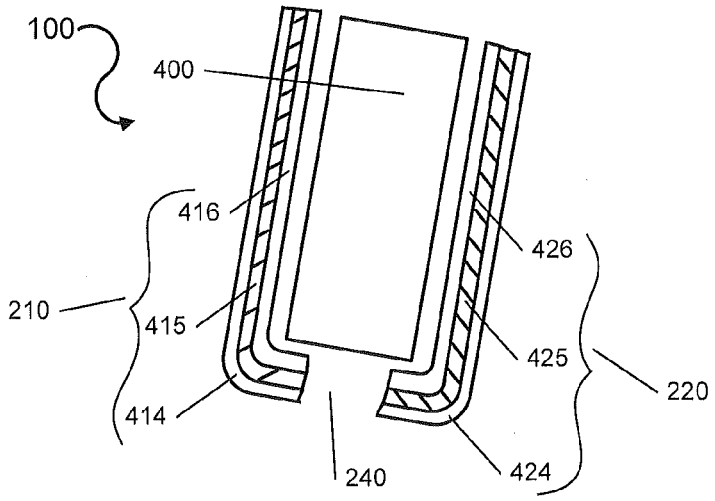

Referring now to FIGS. 4A and 4B, detailed views of transparent antennas of a wireless electronic device 100 are illustrated, according to various embodiments of the present inventive concepts. For example, FIG. 4A illustrates a printed wiring board 400 (e.g., a printed circuit board) between the first, second, and third curved transparent antennas 210, 220, and 230. The printed wiring board 400 may include various components of the wireless electronic device 100, such as the transceiver 342, the processor, 351, and/or the memory 353. Moreover, the printed wiring board 400 may be electrically/physically connected to exciting/feeding elements 411 and 421 for the first and second transparent antennas 210 and 220, respectively. The exciting/feeding elements 411 and 421 may be connected to capacitive feeding elements 412 and 422, respectively. Note that, in some embodiments, transparent antennas 210 and 220 may have less transparency and more conductivity near feeding elements 411 and 421.

Loading/grounding elements 413 and 423 (e.g., inductor loading/grounding elements) may be between the printed wiring board 400 and the first and second transparent antennas 210 and 220, respectively. For example, the loading/grounding elements 413 and 423 may be adjacent respective sides/edges of the wireless electronic device 100, which may reduce interference that might otherwise be caused by a user of the wireless electronic device 100 touching the wireless electronic device 100 at one of the sides/edges. In other words, grounding each of the first and second transparent antennas 210 and 220 at a side/edge of the wireless electronic device 100 (e.g., adjacent a side portion of the housing 200 and the printed wiring board 400) may allow a user to touch the first and/or second transparent antennas 210 and 220 at the sides/edges without causing substantial interference.

Referring still to FIG. 4A, the wireless electronic device 100 may have a length L of about 130.0 mm. Also, the length LR from the printed wiring board 400 to the outer edge of the first transparent antenna 210 or the second transparent antenna 220 along one end of the wireless electronic device 100 may be about 10.0 mm. Accordingly, the distance from the printed wiring board 400 to the other end of the wireless electronic device 100 may be about 120.0 mm (i.e., 130.0 mm minus 10.0 mm). Moreover, the width W of the wireless electronic device 100 (e.g., the distance from an outer edge of the first transparent antenna 210 to an outer edge of the second transparent antenna 220 along sides/edges of the wireless electronic device 100) may be about 66.0 mm. It will be understood, however, that the dimensions of the wireless electronic device 100 may be larger or smaller than those described in examples herein. Additionally, if the third transparent antenna 230 includes two curved portions, then the width W may be the width of the third transparent antenna 230.

Referring to FIG. 4B, each cellular (e.g., LTE) antenna may include a parasitic element electrically coupled to a co-located radiating element. For example, the first and second transparent antennas 210 and 220 may include parasitic elements 414 and 424 coupled to radiating elements 416 and 426, respectively. The parasitic elements 414 and 424 and the radiating elements 416 and 426 may each include a metal. In particular, each of the parasitic elements 414 and 424 may provide a partial metal ring that extends adjacent a perimeter of a backplate of housing 200 from the end portion of housing 200 with the gap 240 to a respective side portion of housing 200.

Each of the parasitic elements 414 and 424 may provide an outer partial metal ring and each of the radiating elements 416 and 426 may provide an inner partial metal ring, such that a distance between each of the parasitic elements 414 and 424 and the printed wiring board 400 (e.g., the transceiver 342) is greater than a distance between each of the radiating elements 416 and 426 and the printed wiring board 400. Moreover, the parasitic elements 414 and 424 may be on frames/carriers 415 and 425 (which are illustrated as cross-hatched in FIG. 4B), respectively. Each of the frames/carriers 415 and 425 may include a dielectric material (e.g., plastic, glass, and/or ceramic). Although the frames/carriers 415 and 425 may separate the parasitic elements 414 and 424 from the respective radiating elements 416 and 426 and housing 200, it will be understood that the parasitic elements 414 and 424, the frames/carriers 415 and 425, and the radiating elements 416 and 426 may have different lengths along the perimeter of the wireless electronic device 100. For example, the radiating elements 416 and 426 may only be at the end of the wireless electronic device 100 having the gap 240, whereas the parasitic elements 414 and 424 may extend adjacent the perimeter of housing 200 from the end of the wireless electronic device 100 having the gap 240 to/along respective side portions of housing 200.

The first and second transparent antennas 210 and 220 may be various types of antennas. For example, if the first transparent antenna 210 includes only one grounding point (e.g., the loading/grounding element 413 along the side/edge of the wireless electronic device 100) adjacent housing 200 and the printed wiring board 400, then the first transparent antenna 210 may be a quarter-wave parasitic antenna. Alternatively, the first transparent antenna 210 may be a half-wave parasitic antenna.

Figure 5:
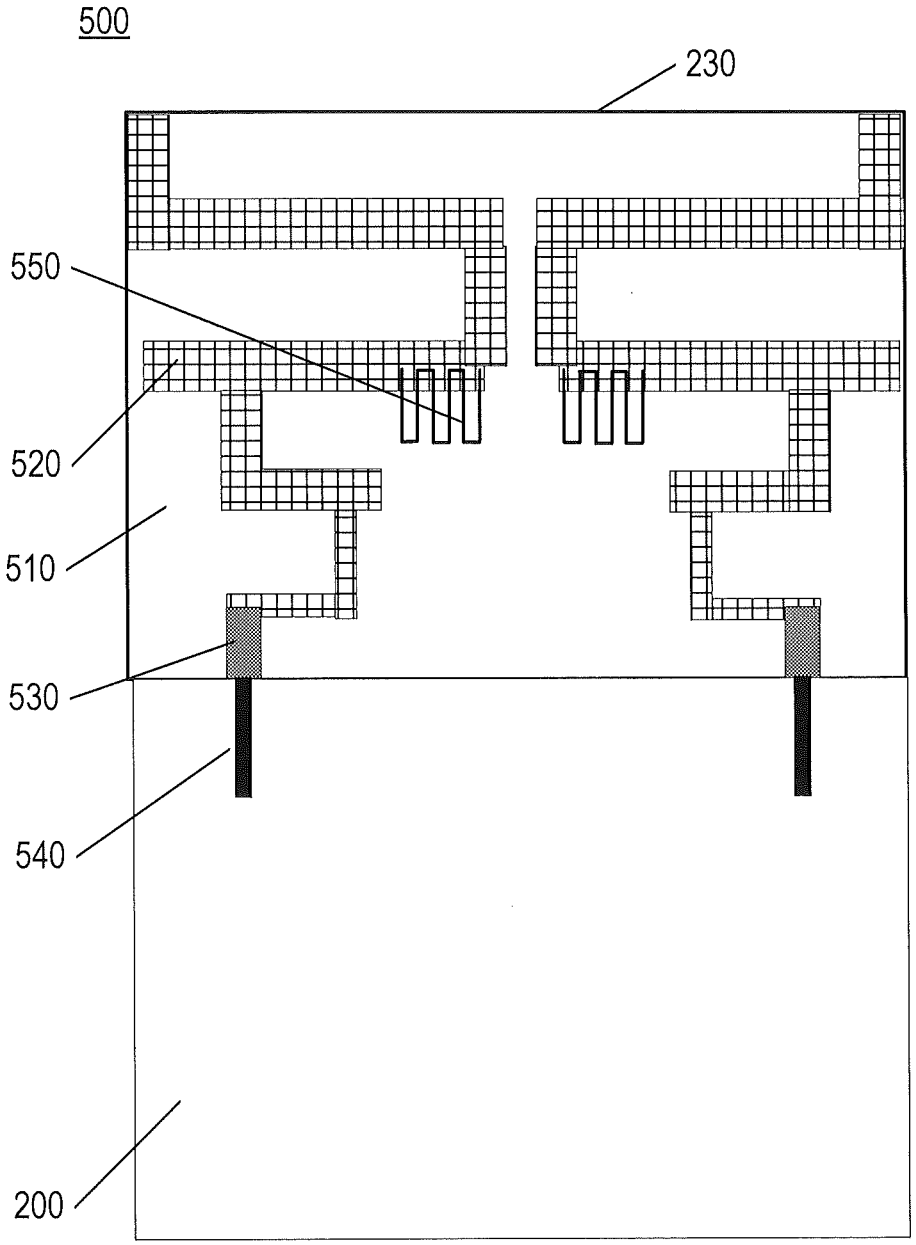
FIG. 5 illustrates a diagram of a transparent mesh antenna, according to various embodiments of the present inventive concepts.

Diagram 500 of FIG. 5 shows a more detailed mesh pattern in a portion of a transparent antenna 510, according to an embodiment. Mesh 520 is patterned in a shape for radiating purposes. Such a shape may follow a thin strip path. Mesh 520 may also cover a larger space in a more planar shape. Different frequency and current requirements may call for different mesh shapes, sizes, materials or patterns. For example, mesh sizes may range from 100 μm to 4-6 mm. In various embodiments, the mesh radiating elements may wrap around the chassis or surrounding dielectric of a wireless terminal.

At certain frequencies, certain locations of antenna 510 may have stronger currents. Therefore, in some cases, a portion 530 of antenna 510 near feed 540 has a change in pattern to account for stronger currents. This change in pattern may make portion 530 of antenna 510 less transparent and more conductive. A denser conductor may be used. This may also be necessary for other electrical and power requirements.

Figure 6:
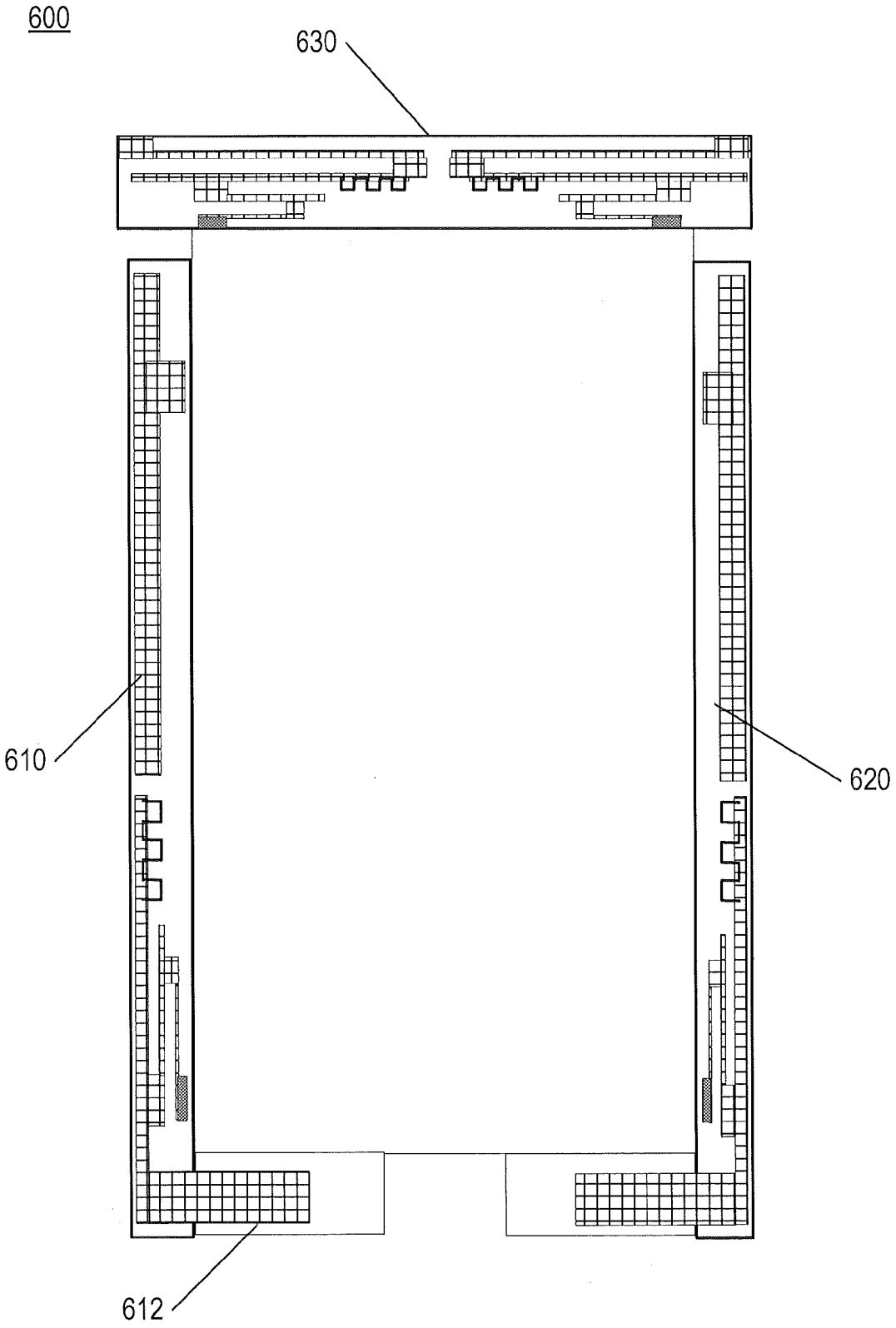
FIG. 6 illustrates another diagram of a transparent mesh antenna, according to various embodiments of the present inventive concepts.

In a further embodiment, meander-line inductor 550 is printed onto the substrate or mesh 520 at a low-band branch. In another embodiment, mesh 520 may also form a high band branch on antenna 510. Other patterns and electrical elements may be printed on, near or in combination with mesh 520. FIG. 6 illustrates another diagram 600 of transparent mesh antennas 610, 620 and 630, which may be located in similar locations as 210, 220 and 230. Diagrams 500 and 600 of FIGS. 5 and 6 are for descriptive purposes. These mesh patterns may or may not be used in embodiments. The size or prominence of the meshes and other elements may vary and are not necessarily meant to be limited to example diagrams 500 and 600.

Figure 7:
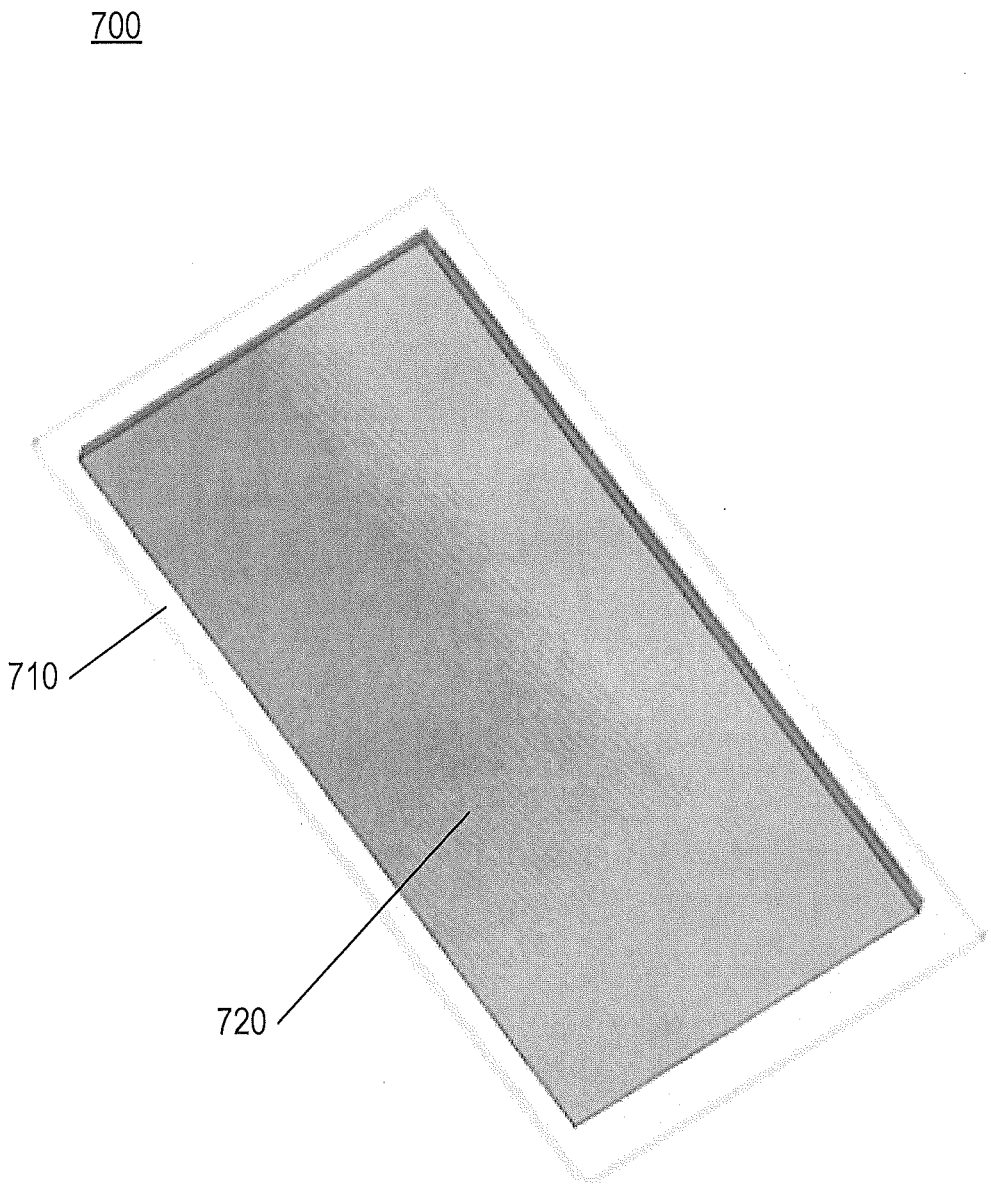
FIG. 7 illustrates a diagram of a transparent ring antenna and a backplate of a housing, according to various embodiments of the present inventive concepts.

FIG. 7 illustrates an external face of a backplate 720 of the wireless electronic device 100, according to an embodiment. Accordingly, the external face of backplate 720 may be visible to, and/or in contact with, a user of the wireless electronic device 100. In contrast, an internal face of backplate 720 may face internal portions of the wireless electronic device 100, such as a transceiver circuit. In some cases, an antenna, such as transparent antenna 710 is separated from backplate 720 (e.g., an end of backplate 720) of the wireless electronic device 100 by a gap, which includes a distance G. Antenna 710 may be at least one of a ring antenna, curved antenna, a cellular antenna, a non-cellular antenna, a diversity antenna, and a C-fed monopole metal antenna. For example, the external face of backplate 720 may be metal and transparent antenna 710 may include a metal mesh that is electrically coupled to metal backplate 720 to provide a C-fed monopole metal (e.g., metal plate) antenna.

As an example, a first radiating element of antenna 710 may be a cellular antenna, a second radiating element of antenna 710 may be a non-cellular antenna, and a third radiating element of antenna 710 may provide a C-fed monopole metal antenna that is a diversity antenna. Alternatively, the third radiating element may be a primary/main cellular antenna, whereas the first radiating element may be a diversity antenna and the second radiating element may be a non-cellular antenna. Furthermore, it will be understood that the third radiating element may be a curved antenna, which may also be a cellular antenna (e.g., a main/primary cellular antenna) or a non-cellular antenna. For example, the first, second, and third radiating elements of antenna 710 may each be partial metal ring antennas.

In some embodiments according to the present inventive concepts, the third antenna may have a dielectric (e.g., plastic) cover. Moreover, backplate 720 of the wireless electronic device 100 may be metal or dielectric (e.g., plastic). Additionally, the gap may provide physical and electrical isolation between the third radiating element and the first and second radiating elements. The gap may also provide physical and electrical isolation (e.g., separation) between the third radiating element and backplate 720 of the wireless electronic device 100. The gap may be a void or may include a dielectric/insulative material. Additionally, the gap may be substantially transparent.

Referring still to FIG. 7, a dielectric frame/carrier may be between the first and second radiating elements and backplate 720 of the wireless electronic device 100. The dielectric frame/carrier may include plastic, glass, and/or ceramic materials. Additionally, the dielectric frame/carrier may provide a slot between backplate 720 of the wireless electronic device 100 and the display 354. The dielectric frame/carrier may be substantially contiguous or may be divided (e.g., divided similarly to the frames/carriers 415 and 425 illustrated in FIG. 4B) by the gap 240. Moreover, although FIG. 7 illustrates the dielectric frame/carrier between the first and second radiating elements and backplate 720 of the wireless electronic device 100, the first and second radiating elements may include respective parasitic elements and respective radiating elements that are on the same side of the dielectric frame or, alternatively, that are separated (e.g., similarly to the separation of the radiating elements 416 and 426 from the parasitic elements 414 and 424 in FIG. 4B) by the dielectric frame.

Figure 8:
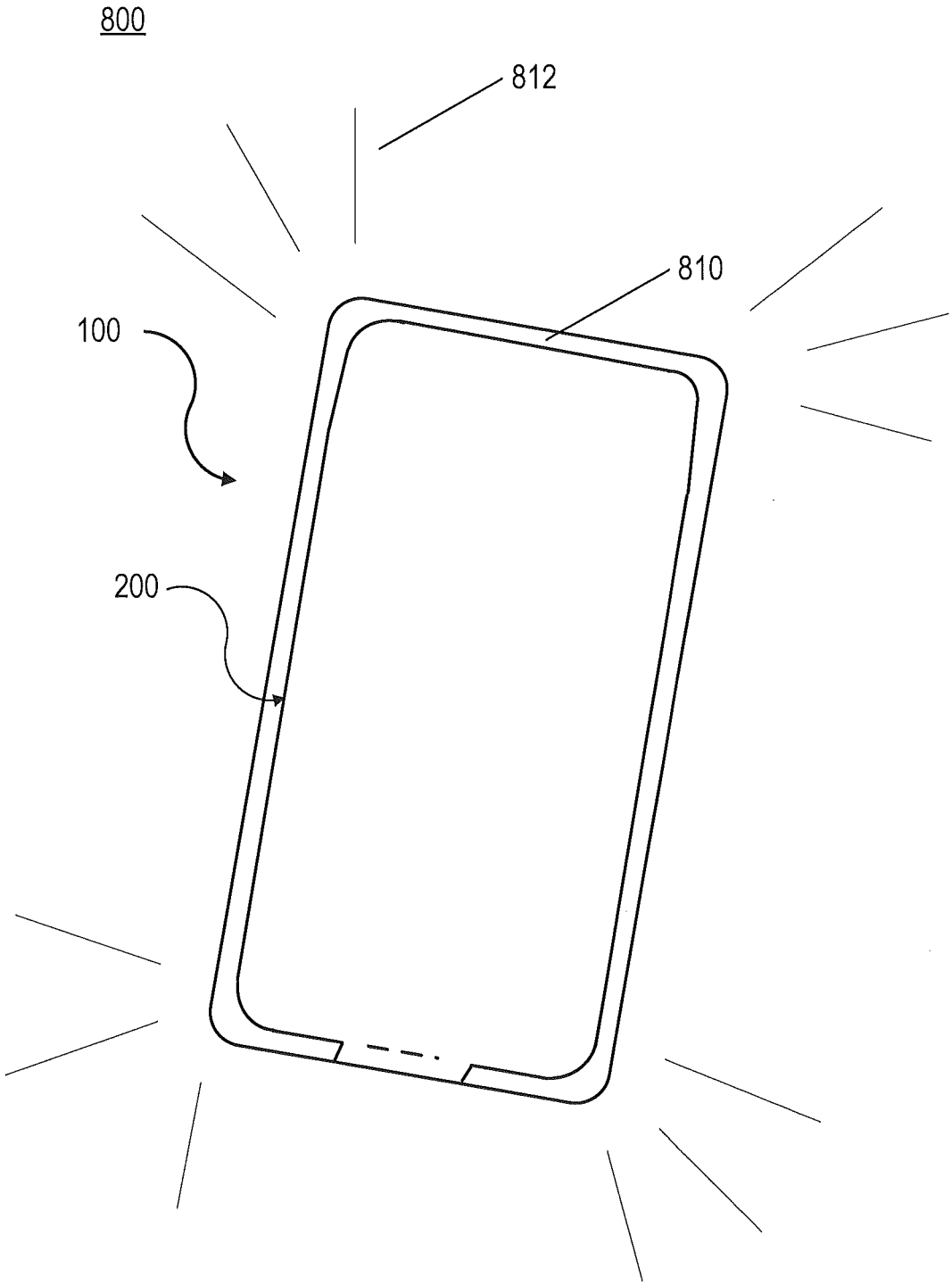
FIG. 8 illustrates another diagram of a transparent ring antenna, according to various embodiments of the present inventive concepts.

FIG. 8 illustrates another example design 800, according to an embodiment. In this example, wireless device 100 has a transparent antenna 810 that is a ring coupled around the perimeter of housing 200. Transparent antenna 810 has one or more radiating elements for cellular and non-cellular communication. By nature of the transparency of transparent antenna 810, a light source of housing 200 may emit light through transparent antenna 810. In various embodiment, a majority of incident light may pass through. In some cases, this may be at least 50% of incident light. In other cases, this may be at least 75% or even at least 90%. This light may be white or any other non-white color. Light may be emitted from corners or sides of a mobile terminal or from the entire ring of the terminal.

Combinations of light colors, color patterns, flashing light patterns or any other visuals may pass through antenna 810. Such colors may be used in correlation with phone features to identify alarms, activities or individuals based on color. For example, a certain color emitted through transparent antenna 810 may indicate a particular user is calling. Such indicators are more easily visible from other angles or distances. This may be useful when a terminal's ringer or alarm has been silenced. In some embodiments, physical or digital images may show through transparent antennas. These and other additional features, such as feeding signals through a capacitive coupling structure, provide more design opportunities for mobile terminals.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless communication terminal comprising:

a housing having opposing faces and four side edges that extend therebetween;

a transceiver in the housing;

a transparent ring antenna electrically coupled to the transceiver that extends around at least three of the side edges of the housing, wherein the transparent ring antenna is configured so that at least a majority of incident light passes through the transparent ring antenna and comprises;

a transparent substrate; and a conductive mesh on the transparent substrate electrically coupled to the transceiver; and a light source in the housing, wherein the light source is configured to emit light through the transparent antenna so as to emerge from at least one of the side edges of the housing.

2. The wireless communication terminal of claim 1, wherein the transceiver is a multi-band transceiver, and wherein the transparent ring antenna is configured to transmit via a plurality of frequency bands responsive to signals generated by the multi-band transceiver.

3. The wireless communication terminal of claim 1, wherein the transparent ring antenna is less transparent and more conductive than the rest of the transparent ring antenna at a portion of the transparent ring antenna near an electrical feed coupled to the transparent ring antenna.

4. The wireless communication terminal of claim 1, wherein the transparent ring antenna is coupled to a dielectric frame that is between the transparent ring antenna and a backplate of the housing, wherein the dielectric frame comprises at least one of plastic, glass or ceramic materials.

5. The wireless communication terminal of claim 1, wherein the transparent ring antenna further comprises;

a first transparent mesh radiating element that extends along a first portion of the side edges of the housing and is configured to transmit and receive non-cellular signals for the radio transceiver; and a second transparent mesh radiating element that extends along a second portion of the side edges of the housing and is configured to transmit and receive cellular signals for the radio transceiver.

6. The wireless communication terminal of claim 5, wherein the transparent ring antenna further comprises a third transparent mesh radiating element that extends along a third portion of the side edges of the housing and is configured to transmit cellular signals for the transceiver, wherein the second and third transparent mesh radiating elements are configured for multiple input multiple output (MIMO) communication.

7. The wireless communication terminal of claim 6, wherein the first transparent mesh radiating element extends around a first side edge of the housing, the second transparent mesh radiating element extends along a second side edge of the housing and a portion of a third side edge of the housing, and the third transparent mesh radiating element extends along a fourth side edge of the housing opposite the second side edge and a portion of the third side edge of the housing.

8. The wireless communication terminal of claim 5, wherein the first transparent mesh radiating element is configured to transmit at least one of local wireless networks, WiFi or global positioning system (GPS) signals.

9. The wireless communication terminal of claim 1, further comprising a printed meander-line inductor on a low-band branch of the conductive mesh.

10. The wireless communication terminal of claim 1, where the light source in the housing is separate from a display of the wireless communication terminal.

11. The wireless communication terminal of claim 10, further comprising:

a processor in the housing which is configured to select at least one color from a plurality of colors for the light source.

12. The wireless communication terminal of claim 11, further comprising:

a processor in the housing which is configured to select a flashing pattern for the light source.

13. The wireless communication terminal of claim 1, wherein one of the opposing faces comprises a touch screen display that is configured to display a plurality of keys thereon and to accept user selection of a key, and wherein the light which emerges from at least one of the side edges of the housing is configured to provide identification of alarms, activities, or individuals based on a color of the light that is emitted through the transparent antenna by the light source.

* * * * *